US005915522A

United States Patent [19]

Clarke

[11] Patent Number: 5,915,522

[45] Date of Patent: Jun. 29, 1999

[54] CONVEYOR SYSTEM FOR ROD-LIKE ARTICLES

[75] Inventor: Peter Alec Clarke, High Wycombe, United Kingdom

[73] Assignee: Molins PLC, Milton Keynes, United Kingdom

[21] Appl. No.: 08/987,021

[22] Filed: Dec. 9, 1997

[30] Foreign Application Priority Data

Dec. 10, 1996 [GB] United Kingdom ..... 9625613

[51] Int. Cl.[6] ..... B65G 1/00

[52] U.S. Cl. ..... 198/347.3

[58] Field of Search ..... 198/347.1, 347.3, 198/347.4, 348, 363

[56] References Cited

U.S. PATENT DOCUMENTS 4,790,422 12/1988 Clarke et al. ..... 198/347.3

5,170,877 12/1992 Francioni ..... 198/347.3 X 5,617,701 4/1997 Brizzi et al. ..... 198/347.3 X

FOREIGN PATENT DOCUMENTS 2353806 5/1974 Germany ..... 198/347.3

2029787 3/1980 United Kingdom ..... 198/347.1

*Primary Examiner*—James R. Bidwell

*Attorney, Agent, or Firm*—Antonelli, Terry, Stout & Kraus, LLP

[57] ABSTRACT

A system for conveying cigarettes in multi-layer stack formation between at least two combinations, each including a cigarette maker (10,10A), packer (14,14A) and buffer reservoir (12,12A), includes an interconnecting conveyor defining a closed loop path (18,20,18A,20A) allowing cigarettes made (or stored) in one combination to pass to the packer of any combination, the arrangement being such that associated with each combination there is an inverted T-junction (16,16A) at which cigarettes are delivered from above to the path from the maker or reservoir, and a further T-junction (22,22A) at which cigarettes are delivered downwards from the path to the packer.

18 Claims, 1 Drawing Sheet

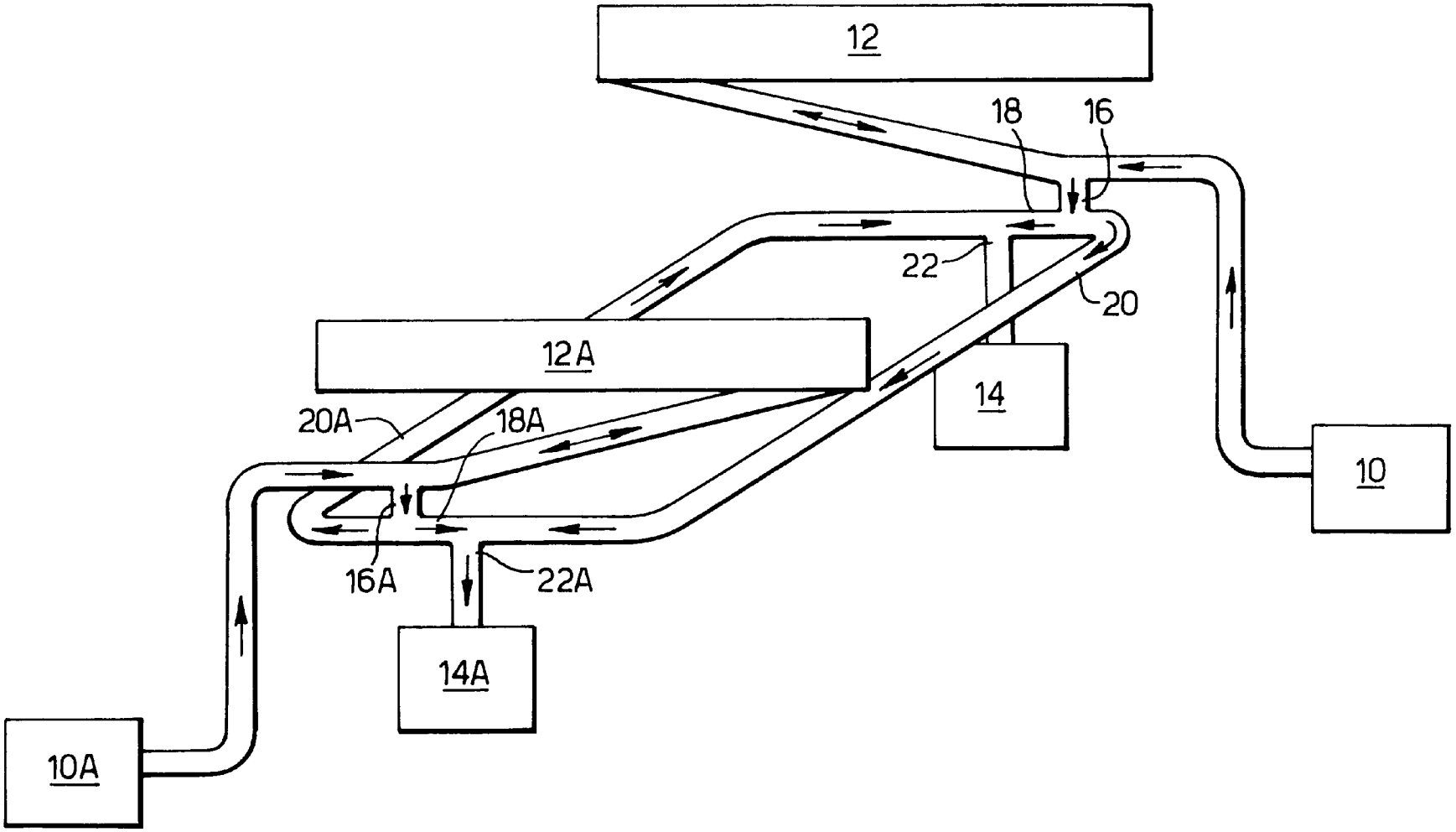
10
12
16
18
20
14
22
12A
18A
22A
14A
16A
20A
10A

CONVEYOR SYSTEM FOR ROD-LIKE ARTICLES

This invention relates to a conveyor system for rod-like articles, particularly a system linking two or more cigarette making machines or cigarette filter rod making machines to two or more cigarette packing machines or filter rod consuming machines.

In U.S. Pat. No. 4,790,422 there is disclosed a conveyor system for rod-like articles in which a plurality of delivery devices and reservoir units is linked to a plurality of receiving devices, the arrangement being such that each delivery device and reservoir unit can deliver articles to each receiving device by means of a conveyor path including a common portion. This arrangement may lead to unnecessary handling of the articles, which can cause degradation of delicate articles such as cigarettes.

According to the present invention a conveyor system for rod-like articles in multi-layer stack formation comprises a plurality of combinations each including a delivery device, reservoir unit and receiving device, and conveyor means extending between said combinations and including associated with each combination a first junction, at which articles are received from at least one of the delivery device and reservoir unit and are directed respectively in different directions along a primary path towards the receiving device of said combination or along a secondary path towards a receiving device in another combination, and a second junction, from which articles are delivered to the receiving device and at which articles are received respectively from different directions along said primary path or along a secondary path from another combination.

In a preferred arrangement the articles are received at said first junction from above, with the junction being preferably in the form of an inverted T, and are delivered downwards from the second junction, with the junction preferably being a T-junction. In this case said directions are preferably substantially horizontal, and in a preferred arrangement the first and second junctions for all of said combinations are at the same level and are arranged on a closed loop path of said conveyor means. By way of explanation, although the path is closed the direction of travel of articles on the path will differ at different parts of the path.

The invention will be further described, by way of example only, with reference to the accompanying diagrammatic drawing, which is a perspective view of a conveyor system for rod-like articles.

The system comprises a first combination including a cigarette making machine 10, a reversible reservoir unit 12 and a cigarette packing machine 14. The system also includes a similar second combination comprising a making machine 10A, a reservoir unit 12A and a packing machine 14A.

Cigarettes are conveyed between the individual elements of each combination and between the combinations in multi-layer stack formation. Cigarettes from the making machine 10 or reservoir unit 12 are delivered to a first junction 16 from which they pass along a conveyor section 18 towards the packing machine 14 or along a conveyor section 20 leading towards the packing machine 14A. It will be understood that there is a similar arrangement at the other combination, where similar parts have been given similar reference numbers with the addition of the suffix "A". The conveyor section 18 leads to a second junction 22 at which cigarettes descend to the packing machine 14. At the junction 22 cigarettes are also received from the other combination along a conveyor section 20A.

In operation, the primary route for cigarettes is by way of the conveyor sections 18 and 18A. Thus the combinations operate independently and the conveyor sections 20 and 20A are not operated. However, in the event that either combination has an over-capacity, e.g. because its packing machine is temporarily out of operation then cigarettes may be fed from that combination to the other combination. Clearly in such case it may be necessary to increase the speed of operation of the appropriate packing machine and/or reduce the speed of one or both of the making machines and/or modify the feed of cigarettes to or from one or both of the reservoir units. Note that either of the reservoir units 12,12A may supply product to either of the packing machines 14,14A; similarly, if required, both reservoirs can supply a single packing machine, either simultaneously or sequentially.

I claim:

1. A conveyor system for rod-like articles in multi-layer stack formation comprising a plurality of combinations each including a delivery device, reservoir unit and receiving device, and conveyor means extending between said combinations and including associated with each combination a first junction, at which articles are received from at least one of the delivery device and reservoir unit and are directed respectively in different directions along a primary path towards the receiving device of said combination or along a secondary path towards a receiving device in another combination, and a second junction, from which articles are delivered to the receiving device and at which articles are received respectively from different directions along said primary path or along a secondary path from another combination.

2. A conveyor system as claimed in claim 1, including means for delivering articles to said first junction from above.

3. A conveyor system as claimed in claim 2, wherein the first junction comprises an inverted T-junction.

4. A conveyor system as claimed in claim 1, including means for delivering articles downwards from said second junction.

5. A conveyor system as claimed in claim 4, wherein the second junction is in the form of a T-junction.

6. A conveyor system as claimed in claim 1, wherein said primary and secondary paths extend generally horizontally.

7. A conveyor system as claimed in claim 6, wherein the primary and secondary paths extend in a closed loop path containing said first and second junctions.

8. A conveyor system for rod-like articles in multi-layer stack formation, including a plurality of delivery devices, a plurality of receiving devices; and a conveyor extending between said devices and including a closed loop path extending in a substantially horizontal plane, a plurality of first junctions at which articles are delivered to said path from respective delivery devices, and a plurality of second junctions at which articles are delivered downwards from said path to respective receiving devices.

9. A conveyor system as claimed in claim 8, including means for conveying articles unidirectionally in opposite directions on said path on opposite sides of said first and second junctions.

10. A conveyor system as claimed in claim 8, wherein said first junctions deliver articles downwardly from above to said path.

11. A conveyor system as claimed in claim 10, wherein said first junctions are substantially in the form of inverted T-junctions and said second junctions are substantially in the form of T-junctions.

12. A conveyor system for rod-like articles in multi-layer stack formation, comprising a plurality of combinations, each combination including a delivery device, a reservoir unit and a receiving device; and a conveyor extending between said combinations, and including, associated with each combination, a respective first junction at which articles are received from at least one of the delivery device and reservoir unit of the combination and are directed respectively in different directions along a primary path towards the receiving device of said combination or along a secondary path towards a receiving device in another combination, and a respective second junction from which articles are delivered to the receiving device of said combination and at which articles are received respectively from different directions along said primary path or along a secondary path from said another combination.

13. A conveyor system as claimed in claim 12, wherein said conveyor includes a portion in the form of a closed loop path on which articles are conveyed unidirectionally in opposite directions.

14. A conveyor system for rod-like articles in multi-layer stack formation, comprising a plurality of combinations, each combination including a delivery device, a reservoir unit and a receiving device; and a conveyor extending between said combinations, and including, associated with each combination, a first junction at which articles are received from at least one of the delivery device and reservoir unit of the combination and are directed respectively in different directions along a primary path towards the receiving device of said combination or along a secondary path towards a receiving device in another combination, and a second junction from which articles are delivered to the receiving device of said combination and at which articles are received respectively from different directions along said primary path or along a secondary path from said another combination, said first junction being upstream of said second junction.

15. A conveyor system as claimed in claim 14, wherein said conveyor includes a portion in the form of a closed loop path on which articles are conveyed unidirectionally in opposite directions.

16. A conveyor system for rod-like articles in multi-layer stack formation, comprising a plurality of combinations, each combination including a delivery device and a receiving device; and a conveyor extending between said combinations, and including, associated with each combination, a respective first junction at which articles are received from the delivery device of the combination and are directed respectively in different directions along a primary path towards the receiving device of said combination or along a secondary path towards a receiving device in another combination, and a respective second junction from which articles are delivered to the receiving device of said combination and at which articles are received respectively from different directions along said primary path or along a secondary path from said another combination.

17. A conveyor system as claimed in claim 16, wherein at least one of said combinations includes a reservoir connected to the respective first junction of the combination.

18. A conveyor system as claimed in claim 16, wherein said conveyor includes a portion in the form of a closed loop path on which articles are conveyed unidirectionally in opposite directions.

* * * * *